US005770548A

United States Patent [19]

Leskowicz et al.

[11] Patent Number: 5,770,548

[45] Date of Patent: Jun. 23, 1998

[54] RINSEABLE HARD SURFACE CLEANER COMPRISING SILICATE AND HYDROPHOBIC ACRYLIC POLYMER

[75] Inventors: James J. Leskowicz; Marygrace G. Horner, both of Racine, Wis.

[73] Assignee: S. C. Johnson & Son, Inc., Racine, Wis.

[21] Appl. No.: 649,936

[22] Filed: May 14, 1996

[51] Int. Cl.[6] ..... C11D 3/08; C11D 3/37; C11D 3/43

[52] U.S. Cl. ..... 510/181; 134/26; 134/29; 510/182; 510/434; 510/435; 510/476; 510/511

[58] Field of Search ..... 510/180, 181, 510/182, 434, 435, 476, 511, 533; 134/26, 29; 252/DIG. 10

[56] References Cited

U.S. PATENT DOCUMENTS

| | | | |
|---|---|---|---|
| 3,922,230 | 11/1975 | Lamberti et al. | 510/476 |
| 3,939,090 | 2/1976 | Zmoda | 510/182 |
| 3,964,689 | 6/1976 | Horvath, Jr. | 239/318 |
| 3,994,744 | 11/1976 | Anderle et al. | 134/4 |
| 4,031,022 | 6/1977 | Vogt et al. | 510/476 |
| 4,144,185 | 3/1979 | Block | 510/253 |
| 4,170,805 | 10/1979 | Kumagai | 15/321 |
| 4,240,919 | 12/1980 | Chapman | 510/369 |
| 4,460,568 | 7/1984 | Strasilla et al. | 424/70.16 |
| 4,460,570 | 7/1984 | Strasilla et al. | 424/70.16 |
| 4,486,329 | 12/1984 | Ellis et al. | 510/424 |
| 4,539,145 | 9/1985 | Alvarez et al. | 510/421 |
| 4,583,688 | 4/1986 | Crasper | 239/314 |
| 4,690,779 | 9/1987 | Baker et al. | 510/433 |
| 4,725,319 | 2/1988 | Osberghaus | 134/4 |
| 4,746,455 | 5/1988 | Matsuda et al. | 510/337 |
| 4,844,821 | 7/1989 | Mermelstein et al. | 510/328 |
| 4,847,004 | 7/1989 | McLeod | 510/427 |
| 5,004,557 | 4/1991 | Nagarajan et al. | 510/337 |
| 5,332,519 | 7/1994 | Mazzola | 510/351 |
| 5,399,285 | 3/1995 | Kanluen | 510/427 |
| 5,516,459 | 5/1996 | Van Eenam | 510/365 |
| 5,585,034 | 12/1996 | Lysy et al. | 510/403 |
| 5,597,793 | 1/1997 | Besse et al. | 510/434 |

FOREIGN PATENT DOCUMENTS

| | | |
|---|---|---|
| 94/28101 | 12/1994 | WIPO . |

*Primary Examiner*—Ardith Hertzog

[57] ABSTRACT

Disclosed are hard surface cleaners such as glass window cleaners. A silicate/hydrophobic acrylic polymer/surfactant composition is used to reduce water spotting, filming or streaking. These cleaners can also include a base and a sequestrant.

8 Claims, No Drawings

RINSEABLE HARD SURFACE CLEANER COMPRISING SILICATE AND HYDROPHOBIC ACRYLIC POLYMER

TECHNICAL FIELD

The present invention relates to hard surface cleaners used in environments where drying is accomplished by run-off of rinse water followed by evaporation of any remaining liquid.

BACKGROUND ART

It is often desirable to apply a cleaner to a dirty surface, rinse the cleaner off with water, and then let the surface air dry (without using a cloth to dry the surface). For example, it can be difficult to reach the outsides of certain windows in order to dry them with a cloth, squeegee, or the like. Also, to preserve car finishes or to save labor it is desirable to avoid hand drying vehicles exiting a car wash. Dishwashers also use air drying.

The art has previously developed dispensers for dispensing liquid concentrates from garden hoses or the like. See e.g. U.S. Pat. No. 3,964,689. The disclosure of this patent, and of all other publications referred to herein, are incorporated by reference as if fully set forth herein. A flow of water aspirates, dilutes, and then sprays the cleaner onto a vehicle, a building window, or another surface. Alternatively, gravity feed or simple spray systems are known.

However, many conventional cleaners leave spots, films, and streaks if used in this way. Moreover, when some cleaners are used in a garden hose aspiration system (to project the cleaner out the garden hose nozzle), the dilution destroys the effectiveness of the detergent. Yet another problem is that there are temperatures at which certain cleaners become unstable or ineffective (e.g. they reach a cloud point).

Hot water is often used in car washes, and almost always used in dishwashers. Garden hoses supply a range of very cold to almost body temperature water.

Still other problems can be caused by the wide variety of greases, soils, and other cleaning challenges faced by such cleaners.

The art has previously developed a variety of concentrates for such applications. They often contain a surfactant, a sequestrant (e.g. EDTA), and sometimes a base. However, existing systems have not solved all of the above problems. A need still exists for improved hard surface cleaners.

DISCLOSURE OF INVENTION

In one aspect, the invention provides a hard surface cleaner (e.g. a glass cleaner). The cleaner contains a silicate selected from the group consisting of alkali metal silicate and alkali earth metal silicate. The silicate is between 0.0000001% and 1% by weight of the cleaner. There is also a hydrophobic acrylic polymer that is between 0.000001% and 10% by weight of the cleaner, and a surfactant that is at least 0.01% (preferably 5–20%) of the cleaner.

While the water content of the cleaner can be at least 5% by weight, preferably it is at least 50% by weight (even in the concentrate form). At the point of use, the cleaner can be more than 95% water.

The cleaners of the present invention appear to operate best in an alkaline environment, but work very well from pH 5 to pH 13. Thus, they can also contain an extra added base, such as one selected from the group consisting of alkali metal hydroxide and alkali metal carbonate. A variety of other bases are also suitable (e.g. ammonia).

Garden hose water and tap water often contain minerals which increase the risk of spotting. It is therefore preferred to also include a sequestrant in the cleaner. Especially preferred sequestrants are EDTA and sodium gluconate. Other sequestrants are sodium citrate, calcium citrate, citric acid, calcium gluconate, gluconic acid, acetic acid, sodium phytate, calcium phytate, phytic acid, tetrasodium salts of EDTA, phosphates, sodium carbonate, sodium sesquicarbonate, NTA, sodium polyacrylates and specialty chelators such as Gantrex S-95, Cheelox 354, Kelig 32, or Accusol 445.

Another ingredient is the hydrophobic acrylic polymer, preferably in the form of an acrylic water emulsion. Acrylic polymers are composed primarily of ester monomers of the acrylic family, such as ethyl acrylate, methyl methacrylate, butyl methacrylate, methyl acrylate, and 2-ethyl hexylacrylate. Molecular weights for such polymers are preferably well above 10,000 (e.g. about 500,000). Such acrylic polymers can also contain lesser amounts of other types of monomers, such as styrene or acrylonitrile, polymerized therewith.

Along with the acrylic polymers there can also be copolymers or related compounds such as ethyl acrylate, methacrylic acid, a,a-dimethyl-m-isopropenyl-benzylisocyanate adduct with nonylphenoxy poly (ethyleneoxy) ethanol polymer.

Especially preferred acrylic polymers are the hydrophobically enhanced Ucar Polyphobe 102, Union Carbide; and Accusol 820 or Accusol 823, Rohm & Haas.

These acrylic polymers are water emulsions and they are hydrophobically modified so as to act in an alkaline aqueous environment which is marketed and sold as a swellable thickener.

Hydrophobic modification can be achieved with cross-linking or branching of the polymers. It is preferred that thickening occurs both through chain entanglement and association.

A wide variety of different surfactants can be used to practice the present invention such as anionic surfactants, non-ionic surfactants, cationic surfactants, amphoteric surfactants and zwitterionic surfactants. For glass window applications, a mixture of anionic and non-ionic surfactants is slightly preferred.

Examples of surfactants are Variquat 66 (Witco Corp.) (tallow alkyl bis(polyethoxy) ethyl ammonium, ethyl sulfate); Triton DF-12 (Union Carbide) (modified polyethoxylated alcohol); Accusol 460 ND (sodium acrylate) (Rohm & Haas); Mackamide CS (cocamide DEA-1:1) (McIntyre Chemical); sodium xylene sulfonate (Stepan Chemical); monoethanolamine (Occidental Chemical Corp.). A variety of other surfactants can be used. These include anionic surfactants such as alpha olefin sulfonates, the alkyl aryl sulfonic acids and their alkali metal and alkaline earth metal salts such as sodium dodecyl benzene sulfonate, magnesium dodecyl benzene sulfonate, disodium dodecyl benzene disulfonate and the like, as well as the alkali metal salts of fatty alcohol esters of sulfuric and sulfonic acids, the alkali salts of alkyl aryl (sulfothioic acid) esters, alkyl thiosulfuric acid and soaps such as coco or tallow, etc.

Nonionic surfactants include the ethylene oxide ethers of alkyl phenols such as (nonylphenoxy) polyoxyethylene ether, the ethylene oxides ethers of fatty alcohols such as tridecyl alcohol polyoxyethylene ether, the propylene oxide ethers of fatty alcohols, the ethylene oxide ethers of alkyl mercaptans such as dodecyl mercaptan polyoxyethylene thioester, the ethylene oxide esters of acids such as the polyethylene glycolester of lauric acid the ethylene oxide ethers of fatty acid amides, the condensation products of ethylene oxide with partial fatty acid esters of sorbitol such as the lauric ester of sorbitan polyethylene glycol ether, and other similar materials.

Amphoteric surfactants include the fatty imidazolines, such as 2-coco-1 hydroxyethyl-1 carboxymethyl-1hydroxylimidazoline and similar compounds made by reacting monocarboxylic fatty acids having chain lengths of 10 to 24 carbon atoms with 2-hydroxy ethyl ethylene diamine and with monohalo monocarboxylic fatty acids.

Cationic surfactants include (but are not limited to) modified amines and quaternary ammonium compounds (e.g. cetyl trimethyl ammonium bromide).

An additional class of surfactants are amine oxides which demonstrate cationic surfactant properties in acidic pH and nonionic surfactant properties in alkaline pH. Example amine oxides include alkyl dimethyl amine oxide, dihydroxyethyl cocamine oxide, tallowamidopropylamine oxide and lauryl dimethylamine oxide.

Note that if one uses the acrylic polymers of the present invention with surfactant, but without the silicate, there is often some spotting. Alternatively, if one uses the silicate without the polymer, while spotting is reduced, a filming problem can arise. Also, too high a level of silicate can lead to etching of glass (e.g. sodium metasilicate can etch glass at above 0.025% in the diluted formulations).

However, the combination of the hydrophobic acrylic polymer and the silicate, within the specified ranges, significantly reduces spotting and residual film, yet avoids glass etching. This enables the surfaces to be air dried.

The preferred silicate is sodium silicate ($Na_2O.SiO_2$), preferably somewhere between $Na_2O.3.75\ SiO_2$ and $2Na_2O.SiO_2$, such as "Starso" (The PQ Corporation). Alternatively, the silicate can be potassium silicate, calcium silicate, or one of the other alkali metal or alkali earth metal silicates. However, sodium silicate is highly preferred.

If desired, an organic solvent can also be added to improve performance when greases are present. Examples of such solvents are glycol ethers (e.g. propylene glycol). For example, one could use those derived from $C_1$ to $C_6$ alcohols and ethylene oxide (e.g., the Cellosolve and Carbitol glycol ethers sold by Union Carbide Corporation) or those derived from $C_1$ to $C_4$ alcohols and propylene oxide (e.g. the Arcosolv propylene glycol ethers sold by the ARCO Chemical Company). Still other solvents include (but are not limited to) monohydric alcohols, such as ethanol or isopropanol, or polyhydric alcohols such as propylene glycol or hexylene glycol.

Other standard ingredients can also be added, such as dyes, perfumes, wetting agents, other builders, and the like.

In another form, the invention provides a method for cleaning a hard surface. The above cleaners (e.g. the glass cleaners) are applied to the hard surface. One then rinses the surface with water, and allows the surface to dry by run-off and evaporation. Preferably, the surface is a vertical surface so that most of the water will run-off very quickly. The evaporation can be normal air drying, or the evaporation rate can be expedited by heating (e.g. in a dishwasher).

When used as a glass cleaner, the cleaner is preferably marketed as a concentrate suitable to be fed into a garden hose aspirator (e.g. U.S. Pat. No. 4,583,688), or a gravity feed system, or some other standard delivery system. The concentrate is suitable to be diluted with water (typically by a factor of 20:1 to 100:1; e.g. 80:1). The water/cleaner mixture is then sprayed onto the surface to be cleaned (such as hard to reach windows at the second floor level of a two story home).

After an initial spraying, the concentrate supply is closed off from the aspirator system so that rinse water can be supplied. The windows are then rinsed with clean water, after which the windows are left to air dry. Even without having to scrub or to dry the windows with a cloth, dirty windows cleaned with this method turned out essentially spot free, streak free, and film free.

The cleaners of the present invention can also be used in a conventional car or truck wash. Such cleaners can be fed into a spray spigot at an early position along the washing line. Thereafter, rinse water rinses off the vehicle. The vehicle is then left to air dry after the usual air blowing removes most of the water. This will in most cases avoid the need for abrasive contact with the vehicle. Moreover, a substantial labor saving will result as there will be no need to hand dry the car so as to avoid water spots.

Another use for the present invention is as a dishwasher detergent. A detergent concentrate can be used early in the wash cycle, followed by a clean water rinse.
Heat/air drying can then follow.

A perfectly clean glass surface is hydrophilic. Rinse water is able to wet out well on perfectly clean glass. However, if the rinse water contains dissolved salts (as in medium to hard water), these salts may be deposited onto the glass surface when the water evaporates. A thin sheet of dissolved salts will then be left on the surface. Depending on the water hardness and amount of dried salts per unit area left, the thin sheet left may cause an observable film. Typical prior art rinse aids work on the principal of reducing the surface tension of the rinse water so that it will wet more, thus promoting a sheeting action. In addition, rinse aids are formulated to work with warm surfaces. On a less than perfectly clean surface and using cold water rinse, with conventional rinse aids, sheeting action takes place very slowly, thus allowing dissolved salts to dry to a noticeable film when using a medium to hard water rinse, before they can drain off the surface.

The polymers of the present invention work by adsorbing onto the soiled glass surface during the wash phase, and upon rinsing improve the draining action, reducing filming and spotting while promoting faster drying. These polymers tend to make the rinse water collect and drain, rather than wetting out and sheeting on the surface. The addition of silicate appears to lower the glass/water interfacial tension of the remaining droplets. These remaining water spots are not noticeable when they dry because as the water evaporates and the dissolved salts are deposited onto the surface, a thin sheet forms and there are not enough dissolved salts per unit area to cause noticeable deposits. The polymer and the silicate together synergize to give improved drainage and spot free performance. In our experiments, the cleaner the surface, the more effective will the polymers/silicate rinse effect be.

These compositions perform well within temperature ranges of water typically found in a garden hose supply (33° F.–80° F.), and also work at higher temperatures such as those typically found in a dishwasher (e.g. 120° F.).

It has also been observed that the compositions of the present invention unexpectedly demonstrate better cleaning and rinseability at increased water hardness (from about 120 ppm to about 380 ppm calcium of carbonate).

The objects of the present invention therefore include providing a cleaner of the above kind:

(a) having desirable cleaning characteristics without the need for physical rubbing;

(b) which can be rinsed off and dried without leaving readily visible films, streaks or spots;

(c) which is relatively inexpensive to produce;

(d) which works in a wide variety of temperatures and pH's; and (e) which uses environmentally acceptable components.

These and still other objects and advantages of the present invention (e.g. methods for using such cleaners) will be apparent from the description which follows. The following description is merely of the preferred embodiments. Thus, the claims should be looked to in order to understand the full scope of the invention.

BEST MODES FOR CARRYING OUT THE INVENTION

EXAMPLE 1

A cleaner concentrate was prepared having the following formula:

| Trade Name | Chemical Name | Concentrate |
|---|---|---|
| Accusol 460ND | sodium acrylate | 0.6 |
| Ucar Polyphobe 102 | hydrophobic polymer, 25% active | 0.8 |
| Variquat 66 | tallow alkyl bis(polyethoxy)ethyl ammonium, ethyl sulfate | 3.0 |
| Triton DF-12 | modified polyethoxylated alcohol | 3.0 |
| Mackamide CS | cocamide DEA (1:1) | 3.0 |
| — | sodium xylene sulfonate, 40% active | 6.0 |
| — | sodium gluconate | 7.65 |
| Starso | sodium silicate, 37% active | 0.0043 |
| — | monoethanolamine | 0.4 |
| — | water | balance |

We diluted the above concentrate at 80:1 (water to concentrate), and sprayed it on windows using a conventional garden hose type sprayer. We then rinsed the windows with hose water and allowed the windows to dry. The windows dried without visible streaks, spots or films.

EXAMPLE 2

We have created various other cleaner concentrates have formulas in the following range:

| Trade Name | Chemical Name | Ranges |
|---|---|---|
| Accusol 460ND | sodium acrylate | 0–5% |
| Ucar Polyphobe 102 | hydrophobic acrylic polymer, 25% active | .001–5% |
| Variquat 66 | tallow alkyl bis(polyethoxy)ethyl ammonium, ethyl sulfate | 1–15% |
| Triton DF-12 | modified polyethoxylated alcohol | 1–8% |
| Mackamide CS | cocamide DEA (1:1) | 0–15% |
| — | sodium xylene sulfonate, 40% active | 0–30% |
| — | sodium gluconate | 0–20% |
| Starso | sodium silicate, 37% active | .01–3% |
| — | monoethanolamine | 0–5% |
| — | sodium hydroxide | 0–5% |
| — | water | balance |

To formulate the above cleaners we typically mix them in a batch process at room temperature.

The above examples are preferred forms of the invention. Other forms of the invention are also possible and are intended to be within the scope of the claims. For example, a wide variety of hydrophobic acrylic polymers (besides the preferred ones) can be used. "Hydrophobic" means the tendency to repel water.

Also, while the cleaner is preferably presented as a concentrate when sold to consumers, it can be pre-diluted with water and then sold in sprayer bottles (e.g. as a kitchen surface cleaner). Thus, the claims should be looked to in order to judge the full scope of the invention.

INDUSTRIAL APPLICABILITY

A cleaner is provided to clean window glass, the outsides of vehicles, dishes and flatware, and other hard surfaces.

We claim:

1. A method for cleaning a sheet of window glass, comprising:

applying a glass cleaner to a surface of the sheet of window glass;

rinsing the surface with water; and allowing the surface to dry by run-off and evaporation;

wherein the glass cleaner has:

a silicate selected from the group consisting of alkali metal silicate and alkali earth metal silicate, wherein the silicate is between 0.0000001% and 0.025% by weight of the cleaner;

more than 95% water by weight;

a hydrophobic acrylic polymer that is between 0.000001% and 10% by weight of the cleaner; and a surfactant that is at least 0.01% of the cleaner.

2. The method of claim 1, wherein the cleaner further comprises a base selected from the group consisting of alkali metal hydroxide, alkali metal carbonate, and ammonia.

3. The method of claim 1, wherein the cleaner further comprises a sequestrant selected from the group consisting of EDTA and sodium gluconate.

4. The method of claim 1, wherein the acrylic polymer in the cleaner is in a water emulsion.

5. The method of claim 1, wherein the acrylic polymer in the cleaner is formed at least in part from cross-linked ethyl acrylate monomers.

6. The method of claim 1, wherein the surfactant in the cleaner is selected from the group consisting of anionic surfactants, non-ionic surfactants, cationic surfactants, amphoteric surfactants and zwitterionic surfactants.

7. The method of claim 1, wherein the silicate in the cleaner is sodium silicate.

8. The method of claim 1, wherein the cleaner further comprises a glycol ether solvent.

* * * * *

US005770548B1

REEXAMINATION CERTIFICATE (3798th)

United States Patent [19] [11] B1 5,770,548

Leskowicz et al. [45] Certificate Issued Jun. 29, 1999

[54] RINSEABLE HARD SURFACE CLEANER COMPRISING SILICATE AND HYDROPHOBIC ACRYLIC POLYMER

[75] Inventors: James J. Leskowicz; Marygrace G. Horner, both of Racine, Wis.

[73] Assignee: S. C. Johnson & Son, Inc., Racine, Wis.

Reexamination Request:
No. 90/005,068, Aug. 12, 1998

Reexamination Certificate for:

| | |
|---|---|
| Patent No.: | **5,770,548** |
| Issued: | **Jun. 23, 1998** |
| Appl. No.: | **08/649,936** |
| Filed: | **May 14, 1996** |

[51] Int. Cl.[6] ..... C11D 3/08; C11D 3/37; C11D 3/43

[52] U.S. Cl. ..... 510/181; 134/26; 134/29; 510/182; 510/434; 510/435; 510/476; 510/511

[58] Field of Search ..... 510/181, 182, 510/180, 434, 435, 476, 511, 533; 134/26, 29

[56] References Cited

U.S. PATENT DOCUMENTS 5,538,760 7/1996 Sharma ..... 427/388.4

FOREIGN PATENT DOCUMENTS 0 546 828 A1 6/1993 European Pat. Off. .
0 649 898 A2 4/1995 European Pat. Off. .
1 384 244 2/1975 United Kingdom .

*Primary Examiner*—Ardith Hertzog

[57] ABSTRACT

Disclosed are hard surface cleaners such as glass window cleaners. A silicate/hydrophobic acrylic polymer/surfactant composition is used to reduce water spotting, filming or streaking. These cleaners can also include a base and a sequestrant.

REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–8 is confirmed.

* * * * *